US005570474A

United States Patent [19]

Berry et al.

[11] Patent Number: 5,570,474

[45] Date of Patent: Nov. 5, 1996

[54] DRAPE FOR NURSING AND SO FORTH

[76] Inventors: Elizabeth F. Berry, 4500 Lakeshore Rd., No. 33, Fort Gratiot, Mich. 48059; Dana A. Sullivan, 8145 Smiths Creek Rd., Wales Township, St. Clair County, Mich. 48027; Karen R. Leslie, 3562 Parkway, Port Huron, Mich. 48060; Pamela E. Leslie, 598 Lakeside Dr., Port Huron, Mich. 48060

[21] Appl. No.: 440,630

[22] Filed: May 15, 1995

[51] Int. Cl.[6] ..... A41D 1/00; A41D 3/08; A41D 23/00

[52] U.S. Cl. ..... 2/104; 2/88; 2/48; 2/207; 2/273

[58] Field of Search ..... 2/46, 48, 49.1, 2/49.2, 49.3, 49.4, 49.5, 50, 51, 52, 69, 69.5, 75, 104, 105, 106, 88, 89, 115, 273, 207

[56] References Cited

U.S. PATENT DOCUMENTS

| | | | |
|---|---|---|---|
| 1,085,897 | 2/1914 | Feld | 2/273 |
| 1,497,756 | 6/1924 | Jones | 2/48 |
| 1,793,737 | 2/1931 | Estes | 2/48 X |
| 4,631,754 | 12/1986 | Ryan | 2/104 |
| 4,989,268 | 2/1991 | Stolhand | 2/104 |
| 4,995,116 | 2/1991 | Beauchamp et al. | 2/88 X |
| 5,008,960 | 4/1991 | Hemming | 2/104 |
| 5,379,461 | 1/1995 | Wilmers | 2/115 |

FOREIGN PATENT DOCUMENTS

| | | | |
|---|---|---|---|
| 307715 | 3/1989 | European Pat. Off. | 2/49.1 |

*Primary Examiner*—Jeanette E. Chapman
*Attorney, Agent, or Firm*—Christopher John Rudy

[57] ABSTRACT

A drape for nursing and so forth may have a flat member having opposing ends, for lying over a shoulder and to cover a breast and baby of a nursing mother, with the member containing weights about the opposing ends. Another drape for nursing and so forth has a flat member generally in the shape of a semicircle, for lying over a shoulder and to cover a breast and baby of a nursing mother, which has an arc-like recess to accommodate the neck of the mother. A further drape for nursing and so forth has a flat member with two elongate members attached thereto, with the elongate members containing weights at distal ends thereof, wherein the flat member is to cover at least the upper chest area of a wearer with said elongate members lying over the shoulders of the wearer. The drape is generally made of a soft material, and is useful not only for mothers who would nurse their infants in public but also may find utility as an apron or bib for hospital, nursing home or kitchen use.

12 Claims, 1 Drawing Sheet

DRAPE FOR NURSING AND SO FORTH

FIELD

The present invention concerns an article as of clothing for covering at least part of the upper torso of a person, useful in modest nursing, in protecting the wearer from soiling in nursing, feeding, and other endeavors such as cooking, but especially with a mother and her child, providing a discreet, yet functional nursing tool.

BACKGROUND

Modest, yet health conscious, mothers who choose to nurse their infants find it problematical and perhaps socially unacceptable to feed their babies in public. It is often difficult to use a small blanket for this purpose because it may often fall down, may become very warm, and may not be convenient for positioning the baby correctly.

In one approach to the problem, U.S. Pat. No. 5,008,960 (Apr. 23, 1991) to Hemming discloses a nursing garment with a close-knit upper portion which lies over the shoulder of the nursing mother, and which extends down into an expanded, open-knit lower portion which covers the breast and at least part of the baby while nursing. It is disclosed that thus, the upper portion may be used for burping the baby, and the lower portion is sufficiently opaque to provide privacy to the mother, yet adequately Open to allow sufficient ventilation for the baby. In one embodiment, the garment is provided with two sides to cover both breasts, and in another, a single side is covered, in which the upper edge of the upper, close-knit portion is weighted, for example, with 2 ounces of lead pellets, so as to maintain the garment in place over the mother's shoulder.

However, that approach has several drawbacks. Among these are that the garment may not stay in place, to include in the front part while nursing, and a baby may burp up on the mother, missing the small upper portion of the garment.

In another approach, U.S. Pat. No. 4,989,268 (Feb. 5, 1991) to Stolhand discloses a privacy shield for nursing mothers which includes a hook-like member with a first curved portion that fits over the mother's shoulder and a second elongated portion that extends downward over the mother's upper chest area. The shield has a drape for concealing the mother's upper front chest area and a frame for supporting the drape in front of her upper front chest area so that the nursing baby's head may be disposed between the drape and the mother's breast.

However, that approach also has several drawbacks. Among these are that the shield has hard parts to wear over the shoulder and so forth, is inconvenient to carry, and insufficient provision is also made for burping the baby.

It would be desirable to ameliorate, overcome or avoid such continued problems in the art or such art. It would be additionally desirable to provide an article which does so, and which may be employed in additional fields of endeavor.

OBJECTS

Accordingly, it is in object of the present invention to provide an article which can ameliorate, overcome or avoid problems in the art, to include as aforesaid.

It is an object of the invention to avoid such art, to include claims of the aforementioned patents, at least with certain embodiments hereof.

It is a more particular object hereof to provide a nursing drape which stays securely in place.

It is a more particular object hereof to provide a nursing drape which provides for increased modesty in use.

It is a more particular object hereof to provide a nursing drape which is highly effective in burping babies.

It is an object hereof to provide a nursing drape which is easy to manufacture and is pleasing in presentation.

It is an object hereof to provide a drape which may be employed in additional fields of endeavor.

Further objects of the invention are extant, which may be discerned from a reading of the present specification.

SUMMARY

The present invention provides a drape for nursing and so forth, which, in one aspect, comprises a flat member having opposing ends, for lying over a shoulder and to cover a breast and baby of a nursing mother, said member generally of a soft material and containing weights about the opposing ends. In another embodiment, a drape for nursing and so forth comprises a flat member of a soft material generally in the shape of a semicircle, for lying over a shoulder and to cover a breast and baby of a nursing mother, which has an arc-like recess to accommodate the neck of the mother. In a further aspect, a drape for nursing and so forth comprises a flat member with two elongate members attached thereto, all of said members generally of a soft material, said elongate members containing weights at distal ends thereof, wherein the flat member is to cover at least the upper chest area of a wearer with said elongate members lying over the shoulders of the wearer.

The invention is useful in modest nursing, mother-child intimacy, avoiding soiling, and burping the child. It is also useful as a diaper changing cloth, as a warm blanket, and in other practical applications.

Significantly, the invention, in satisfying some if not all of its objects, contributes to a truly effective, modest and pleasing manner to publicly nurse infants at the breast. It ameliorates, solves or avoids problems in the art, and in certain embodiments avoids known art altogether. It is most versatile and easy to use, and it is easy to make as well.

Numerous further advantages attend the invention.

DRAWINGS

The drawings form part of the specification hereof. In the drawings, in which like features are indicated by like numerals, the following is briefly noted:

ILLUSTRATIVE DETAIL

The invention is more fully understood by reference to the following detailed description taken in conjunction with the drawings, which is not necessarily limiting in nature.

In general, drape for nursing and so forth 100 has flat member 11, which is made of a soft material, for example, of a suitable weight, soft, brushed cotton to provide surfaces 12. The flat member 11 may be filled with a soft, cushiony material, for example, batting, be filled with a liquid barrier material, for example, polyethylene sheeting, and/or be made up with one or more sheets of soft material(s). Preferably, the flat member 11 generally has two sheets of soft materials lying planarly in close proximity for the surfaces 12, which are attached by gluing, sewing, and so forth, preferably by sewing to include about border 13. The drape may be trimmed with velvet, lace, tassels, embroidery, and so forth as option(s) which may be desired.

Figure 1:
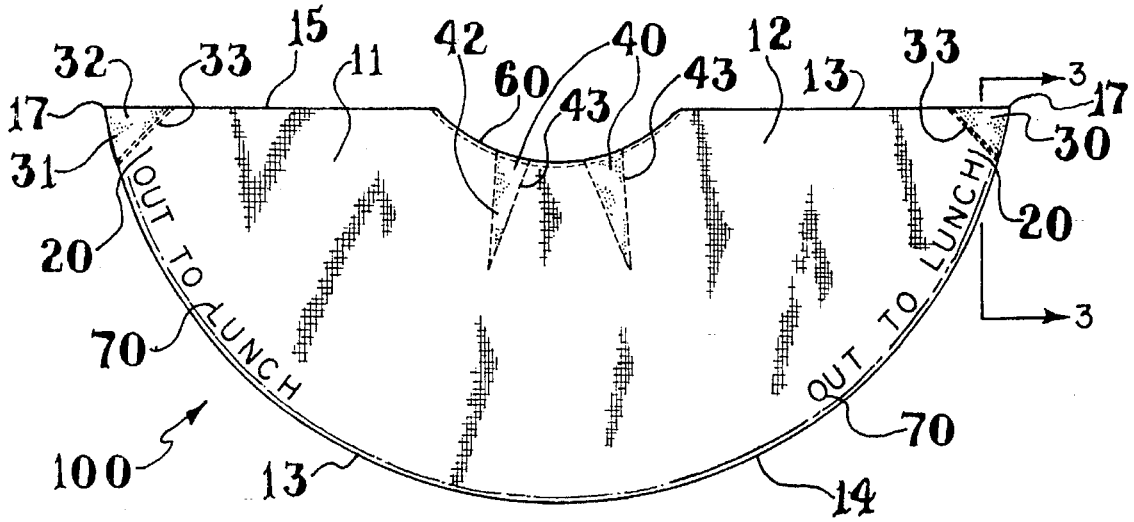
FIG. 1 is a front plan view of a drape for nursing and so forth of the present invention.
Figure 2:
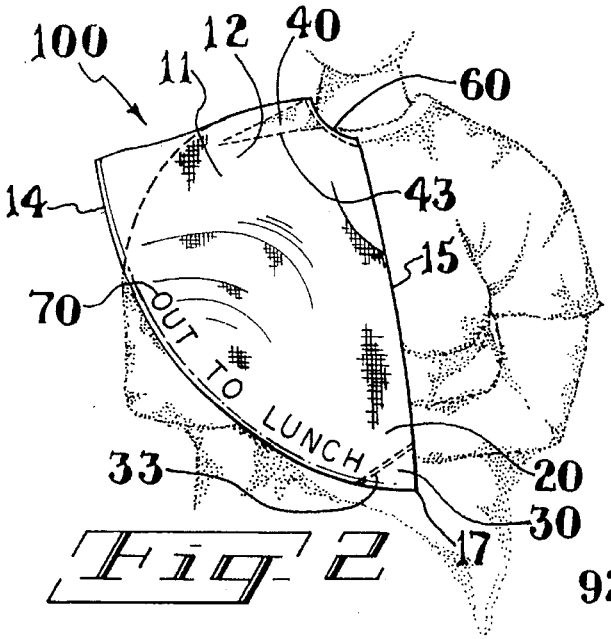
FIG. 2 is a front view of the drape of FIG. 1 in use.
Figure 3:
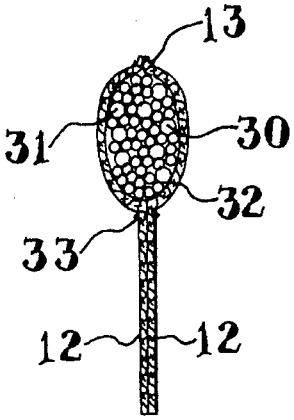
FIG. 3 is a cut away view, taken along the line 3—3, of the drape of FIG. 1, which shows a set of weights thereof.

As generally depicted in FIGS. 1–3, the flat member 11 may have opposing ends 20, as for lying over the shoulder and to cover a breast and baby of the nursing mother. The flat member 11 may be about as wide or wider at a point where it is to lie over the shoulder than at at least one of the opposing ends, advantageous for burping, and so forth, and may contain distal weights 30 about the opposing ends 20, advantageous to keep the drape discreetly in place. Weights may be in the form of beads 31, sand (with proper containment) or beans, and so forth, contained within the material making up the surfaces 12 and be restrained in place by forming distal weight pocket 32 as by gluing, sewing, and so forth, preferably by sewing, so as to provide distal weight pocket border 33. The beads 31 can be, for example, polypropylene pellets, which provide for enhanced washability of the drape 100.

The drape 100 may have shoulder weights 40, of further advantage in keeping the drape in place while it is being worn as by a nursing mother, which may also be in the form of beads, sand (with proper containment) or beans, and so forth, contained within the surfaces 12 and restrained by forming shoulder weight pockets 42 as by gluing, sewing, and so forth, preferably by sewing, so as to provide shoulder weight pocket border 42.

The drape 100 may be in the shape of a half- or semicircle or oval (herein, semicircle) with an arc-like recess 60 to accommodate the neck of the mother. It may contain indicia of use 70, which may be any pleasing, preferably cute and modest, saying. See e.g., FIGS. 1 & 2. However, a more discreet drape may avoid such optional indicia of use.

Figure 4:
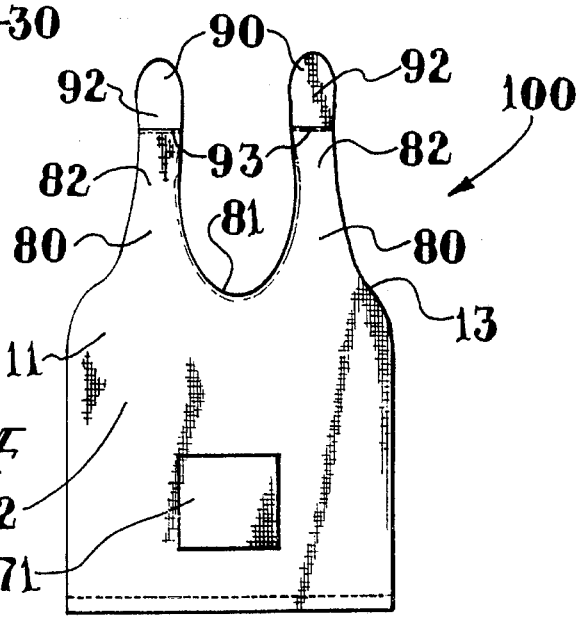
FIG. 4 is a front plan view of another embodiment of a drape for nursing and so forth of the invention.

As generally depicted in FIG. 4, the flat member 11 may have two elongate members 80 attached thereto or a part thereof to form collar 81. These are generally of a soft material such as aforesaid. The elongate members 80 contain weights 90 at distal ends thereof, which may be in the form of beads sand (with proper containment) or beans contained within the material making up the elongate members surface 82 and be restrained in place by forming elongate member distal weight pocket 92 as by gluing, sewing, and so forth, preferably by sewing, so as to provide elongate member distal Weight pocket border 93. These beads may also be of polypropylene. The flat member 11 is to cover at least the upper chest area of a wearer with said elongate members 80 and their weights 90 lying over the shoulders of the wearer.

Pocket 71 also may be present.

In general, dimensions of the drape of the invention may vary as desired. For example, the weighted, semicircular drape 100 of FIG. 1 may have an about 38-inch general diameter with an about 10-inch long by 2½-inch deep arc-like recess and have an about 16-inch dimension from the deepest portion of the arc-like recess to the border opposite the chord considered to be the diameter, and the apron-like drape 100 of FIG. 4 may generally have an about 34-inch bottom width and an about 28-inch height from its bottom edge to its collar with about 21-inch long elongate members. Oversized models may be advantageous.

Specifically, the drape is constructed of a flat member 11 generally in the shape of a semicircle. The flat member 11 includes a generally curvilinear outer boundary 14 on a first side of the member and generally linear boundary 15 defining part of a boundary of the member on a second side of the member. The generally linear boundary 15 intersects with the generally curvilinear outer boundary 14 to form two vertices 17 which oppose one another along an axis substantially parallel to the second side of the member. A neck recess 60 is located in the mid-portion of the generally linear boundary and the recess enters into a center region of the member. The drape, 100, or flat member 11 includes weights 30 about the vertices 17 of the member. Shoulder weights 40 are also present within the boundaries of the flat member about the center region and about a position where the member is to lie over the shoulder of the mother.

Any suitable amount of weight(s) may be employed as may be desired. Advantageously, each distal weight 30 is on the order of 1 ounce to 1½ ounces; shoulder weights 40 may be less, say, on the order of ¼ to ¾ of an ounce each. As well, advantageously, each forming elongate member distal weight 90 is on the order of 4 to 8, e.g., 6, ounces.

The invention is convenient and useful for mothers who would nurse their infants in public with a general assurance of modesty, and can provide an extended area to contain excretions associated with burping the baby so that there is also a general assurance of keeping the mother clean and fresh, particularly when embodied as a front and back and/or shoulder weighted drape and/or a semi-circular type drape. It may be reversible with top and bottom surfaces being able to be reversed, and in the case of the semi-circular type drape it may be reversible about its elongate ends with it able to be employed on either shoulder of the mother. It also may find utility as an apron or bib for hospital, nursing home or kitchen use, or a bib for a baby, toddler or child, where tying of the apron or bib is avoided in the hospital, geriatric, kitchen, or home use, particularly when embodied as an apron-like drape. The drape hereof can stay securely in place, can be used as a burping cloth or a baby sleeping mat or cover, or a diaper changing mat, especially when away from home. It is generally comfortable in use.

CONCLUSION

The present invention is thus provided. Numerous adaptations can be effected within its spirit, the literal claim scope of which is particularly pointed out as follows:

We claim:

1. A drape useful for nursing comprising a flat member of a soft material generally in the shape of a semicircle, which includes a generally curvilinear outer boundary on a first side of the member and a generally linear boundary defining part of a boundary of the member on a second side of the member, which generally linear boundary intersects with the generally curvilinear outer boundary to form two vertices which oppose one another along an axis substantially parallel to the second side of the member, said drape being capable of lying over a shoulder and covering a breast and baby of a nursing mother, which has a neck recess in a mid-portion of the generally linear boundary entering into a center region of the member, which recess can accommodate the neck of the mother, and which drape has added weights about the vertices of the generally semicircular member and additional, shoulder weights present within the boundaries of the flat member about the center region and about a position where the member is to lie over the shoulder of the mother.

2. The drape of claim 1, wherein the additional, shoulder weights are present in the flat member, which radiate from the neck recess, which recess is arc-like, and which additional, shoulder weights are on opposing sides of an axis which passes through a mid-point of the neck recess and is generally perpendicular to the generally linear boundary of the flat member.

3. The drape of claim 2, wherein the added weights about the vertices which oppose one another each total from about 1 ounce to about 1½ ounces.

4. The drape of claim 2, wherein there are two additional, shoulder weights, each about ¼ to ¾ ounce.

5. The drape of claim 3, wherein each additional, shoulder weight is about ¼ to ¾ ounce.

6. The drape of claim 1, wherein includes a cute and modest saying as indicia of use.

7. The drape of claim 1, wherein each of the weights is present as a set of beads in a weight pocket within the member.

8. The drape of claim 2, wherein each of the weights is present as a set of beads in a weight pocket within the member.

9. The drape of claim 3, wherein each of the weights is present as a set of beads in a weight pocket within the member.

10. The drape of claim 4, wherein each of the weights is present as a set of beads in a weight pocket within the member.

11. The drape of claim 5, wherein each of the weights is present as a set of beads in a weight pocket within the member.

12. The drape of claim 6, wherein each of the weights is present as a set of beads in a weight pocket within the member.

* * * * *